US006796889B2

(12) United States Patent
Marton

(10) Patent No.: US 6,796,889 B2
(45) Date of Patent: Sep. 28, 2004

(54) ORBITAL SANDER WITH SUCTION RING

(76) Inventor: Miksa Marton, 2495 Santo, Windsor, Ontario (CA), N9G 2J7

( * ) Notice: Subject to any disclaimer, the term of this patent is extended or adjusted under 35 U.S.C. 154(b) by 74 days.

(21) Appl. No.: 10/054,517

(22) Filed: Nov. 13, 2001

(65) Prior Publication Data

US 2003/0092369 A1 May 15, 2003

(51) Int. Cl.[7] ..... B24B 23/00
(52) U.S. Cl. ..... 451/357; 451/359; 451/456
(58) Field of Search ..... 451/451, 456, 451/453, 344, 350, 352, 354, 357, 359

(56) References Cited

U.S. PATENT DOCUMENTS 4,138,804 A * 2/1979 Thielen ..... 451/342
4,616,449 A * 10/1986 Marton ..... 451/456
5,027,470 A * 7/1991 Takashima ..... 15/385
5,123,139 A * 6/1992 Leppert et al. ..... 15/230.17
5,172,448 A * 12/1992 Kitahata ..... 15/230

* cited by examiner

*Primary Examiner*—Hadi Shakeri
(74) *Attorney, Agent, or Firm*—Fildes & Outland, P.C.

(57) ABSTRACT

A rotary orbital sander includes a motor having a rotatable shaft with a radially off-set portion. A suction housing is mounted to the motor around the motor shaft and connectable with a vacuum source. A sanding pad assembly including a backing pad having a plurality of apertures therethrough and an annular frame having a circumferential side wall including first and second circumferential edges is mounted to the radially off-set portion of the shaft. A circular back wall extends from one of the circumferential edges and has an opening therein sealable with the suction housing. The other circumferential edge is attached to the backing pad. The sanding pad assembly resists flapping at high rotational speeds. A sanding disk having a size and shape complimentary to that of the sanding pad, and a plurality of holes aligning with the apertures in the sanding pad is mountable on the sanding pad. A vacuum source draws sanding waste through the aligned apertures and out the suction housing.

3 Claims, 4 Drawing Sheets

ORBITAL SANDER WITH SUCTION RING

TECHNICAL FIELD

This invention relates to a rotary orbital sander, and more particularly to a rotary orbital sander that is adapted for use with a vacuum source.

BACKGROUND OF THE INVENTION

In U.S. patent application Ser. No. 09/738,305, now U.S. Pat. No. 6,413,157 I disclosed a double action orbital sander having a sanding pad including a plurality of radially extending suction channels for drawing sanding waste through holes in a sanding disk aligned with the annular channels. Although this arrangement has been very effective for collecting and transporting loosened particles to a suction housing, I have improved upon the delivery of vacuum pressure provided through the holes in the sanding disk.

My earlier application also included a unique balancing system that uniquely balanced a pad backing and backing pad mounted on the rotatable shaft and minimized flapping of the pad backing and back up pad under the high rotational operational speed of the pad, that may be in excess of 10,000 rpm. While improving delivery of vacuum presence, I have further improved upon eliminating the flapping associated with the high speed rotation of a large diameter pad backing of a disk shape.

SUMMARY OF THE INVENTION

The present invention provides a suction ring for an orbital sander and/or a rotary orbital sander that improves upon the unobstructed flow of vacuum pressure provided through holes in a backing pad and sanding disk. In this way, the suction ring increases the delivered vacuum pressure to the sanding disk.

The present invention also provides a suction ring that improves upon the elimination of flapping associated with the high speed rotation of a disk shaped pad backing and backing pad of relatively large diameter by providing a bridge-like structure that attaches to the backing pad to work as one piece with the pad backup and backup pad.

The suction ring is provided for use with an orbital sander including a motor having a rotatable shaft with a radially off-set portion, a suction housing mounted to the motor around the motor shaft and connectable with a vacuum source for supplying vacuum pressure around the shaft, and a sanding pad assembly having a plurality of apertures therethrough.

The suction ring includes an annular frame having a circumferential side wall including first and second circumferential edges. The suction ring is disposed between the suction housing and the sanding pad assembly. One of the edges defines an opening and is adapted to mount to the sanding pad assembly. A circular back wall having an opening therein communicates the vacuum pressure from the suction housing to the orbital sanding pad assembly. The back wall is continuous with the other circumferential edge of the circumferential side wall. Sanding waste is communicated through the sanding pad passageways and suction ring to the suction housing.

In one embodiment a plurality of radially disposed ribs extends generally from the circumferential side wall to a like plurality of leg members disposed about the opening in the circular back wall, forming a bridge-like structure attached to the sanding pad assembly which includes a pad backing and back up pad. The suction ring itself is rigid and it stiffens the assembly against deformations that can occur at high rotational velocity, which is often about 10,000 rpm.

The ring may be made generally of metal or high impact plastic, and aluminum is the preferred material.

A rotary orbital sander of the invention includes a motor having a rotatable shaft with a radially off-set portion. A suction housing is mounted to the motor around the motor shaft and connectable with a vacuum source. A sanding pad assembly is mounted to the radially off-set portion of the shaft.

The sanding pad assembly further includes a backing pad having a plurality of apertures therethrough and an annular frame having a circumferential side wall including first and second circumferential edges and disposed between said suction housing and the sanding pad assembly. A circular back wall extends from one of the circumferential edges and has an opening therein sealable with the suction housing. The other circumferential edge is attached to the backing pad.

The sanding pad assembly further includes a sanding disk having a size and shape complimentary to that of the sanding pad, and a plurality of holes aligning with the apertures in the sanding pad.

A sanding pad assembly for use with a rotary orbital sander having a suction housing connectable with a vacuum source for drawing out sanding waste includes a backing pad having a periphery, a plurality of apertures extending through said backing pad, and an annular frame having a circumferential side wall attached to said backing pad and including a circumferential edge defining in part a back wall having an opening in vacuum pressure flow communication with said suction housing.

The sanding pad assembly can further include a sanding disk having a plurality of holes disposed in like fashion to the apertures in the backing pad so that the plurality of holes of the disk align with the apertures in the sanding pad assembly.

These and other features and advantages of the invention will be more fully understood from the following detailed description of the invention taken together with the accompanying drawings.

DETAILED DESCRIPTION OF THE INVENTION

Figure 2:
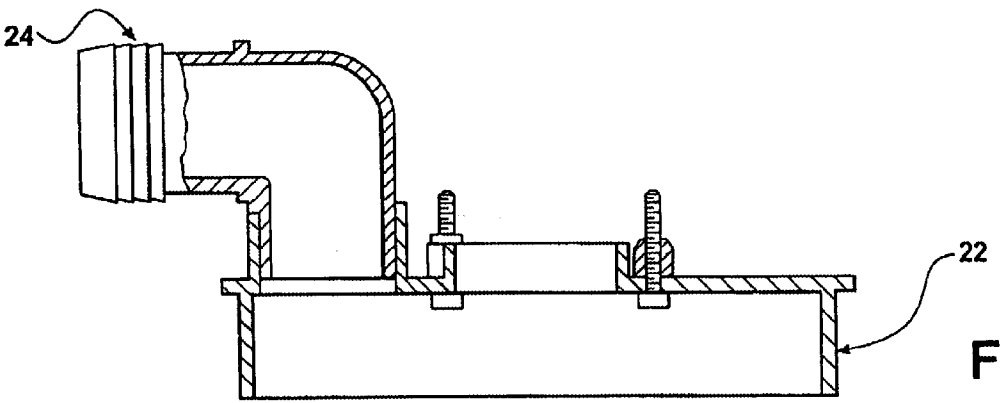
FIG. 2 is a cross-sectional view of a suction housing illustrating a connector adapted for connection with a vacuum source.

Referring now to the drawings in detail, a rotary orbital sander is generally indicated by 10 and includes a system 12 for communicating sanding waste in accordance with the invention. Sander 10 includes a handle 14 mounted to a drive motor 16. Motor 16 has a rotatable shaft 18 with a radially off-set portion 20 extending generally perpendicular to the direction of the handle 14. A suction housing 22 is mounted on the motor 16 and the housing receives and surrounds the rotatable shaft 18. Suction housing 22 is adapted to connect with a vacuum source, for example, a shop vacuum, and includes a connector 24 for such connection illustrated in FIG. 2.

A sanding pad assembly 26 is mounted for rotation on the rotatable shaft 18. The sanding pad assembly 26 includes a disk shaped pad backing 28 that includes a plurality of apertures 30 through which vacuum pressure is communicated. On a backside of pad backing 28 there is attached a suction ring 32 for rotation with the pad backing.

Suction ring 32 comprises an annular frame 34 having a circumferential side wall 36 including first and second circumferential edges 38, 40. Suction ring 32 is disposed between the suction housing 22 and pad backing 28. One of the edges 38 defines an opening and is adapted to mount and/or attach to the pad backing 28. A circular back wall 42 having an opening 44 therein communicates vacuum pressure from the suction housing 22 to the apertures in pad backing 28. The back wall 42 may be continuous with circumferential edge 40 and the opening 44 is spaced closely to the suction housing 22.

Figure 1:
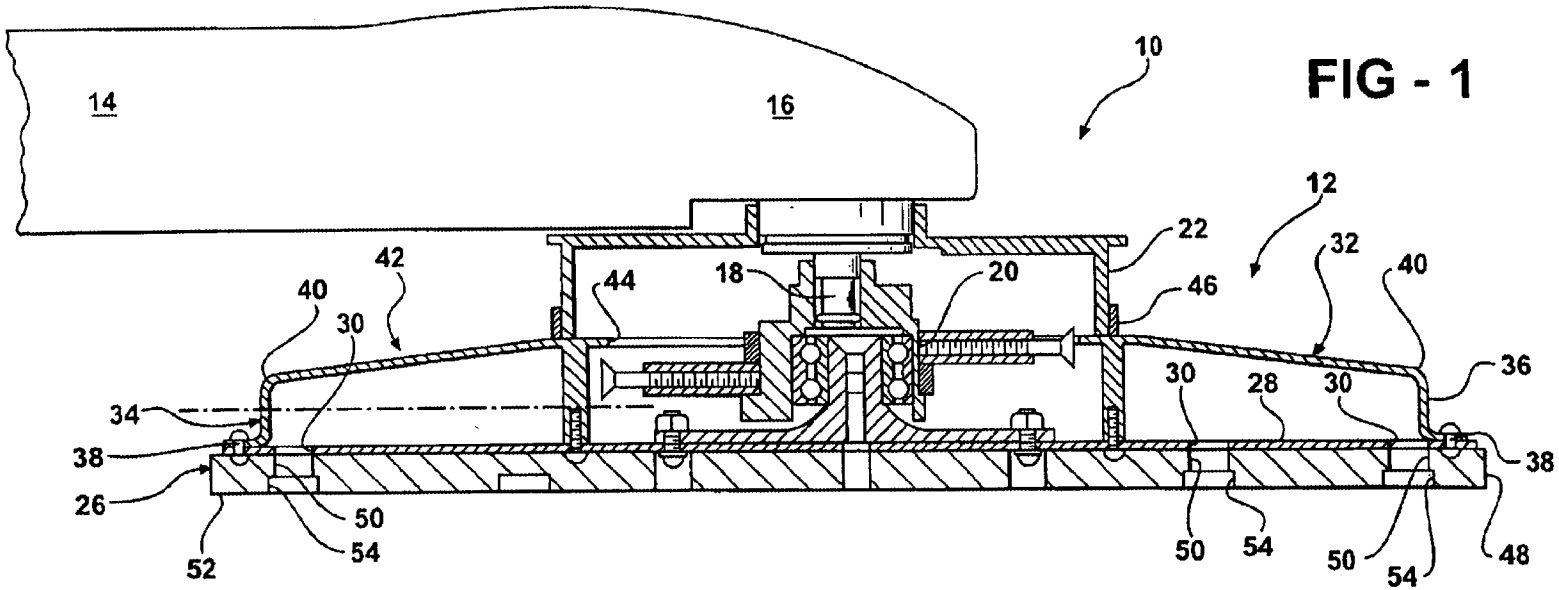
FIG. 1 is a cross-sectional view of a rotary orbital sander constructed in accordance with the present invention.

A seal ring 46, shown in phantom in FIG. 1 may be mounted around suction housing 22 adjacent the suction ring opening 44 and lightly contact the suction ring 32 to prevent false outside air from getting into the flow of vacuum pressure which draws loosened particles or sanding waste.

On the face of the pad backing 28 there is mounted a resilient sanding pad 48 which includes a plurality of apertures 50 similarly disposed as the apertures 30 in pad backing 28. Sanding pad 48 removably mounts a sanding disk 52 having abrasive qualities and a like aperture 54 configuration as apertures 30, 50. As particles are loosened during the sanding process, they are drawn by the vacuum source directly through aligned apertures 30, 50, 54, into the suction ring 32 and out the suction housing 22.

Figure 3:
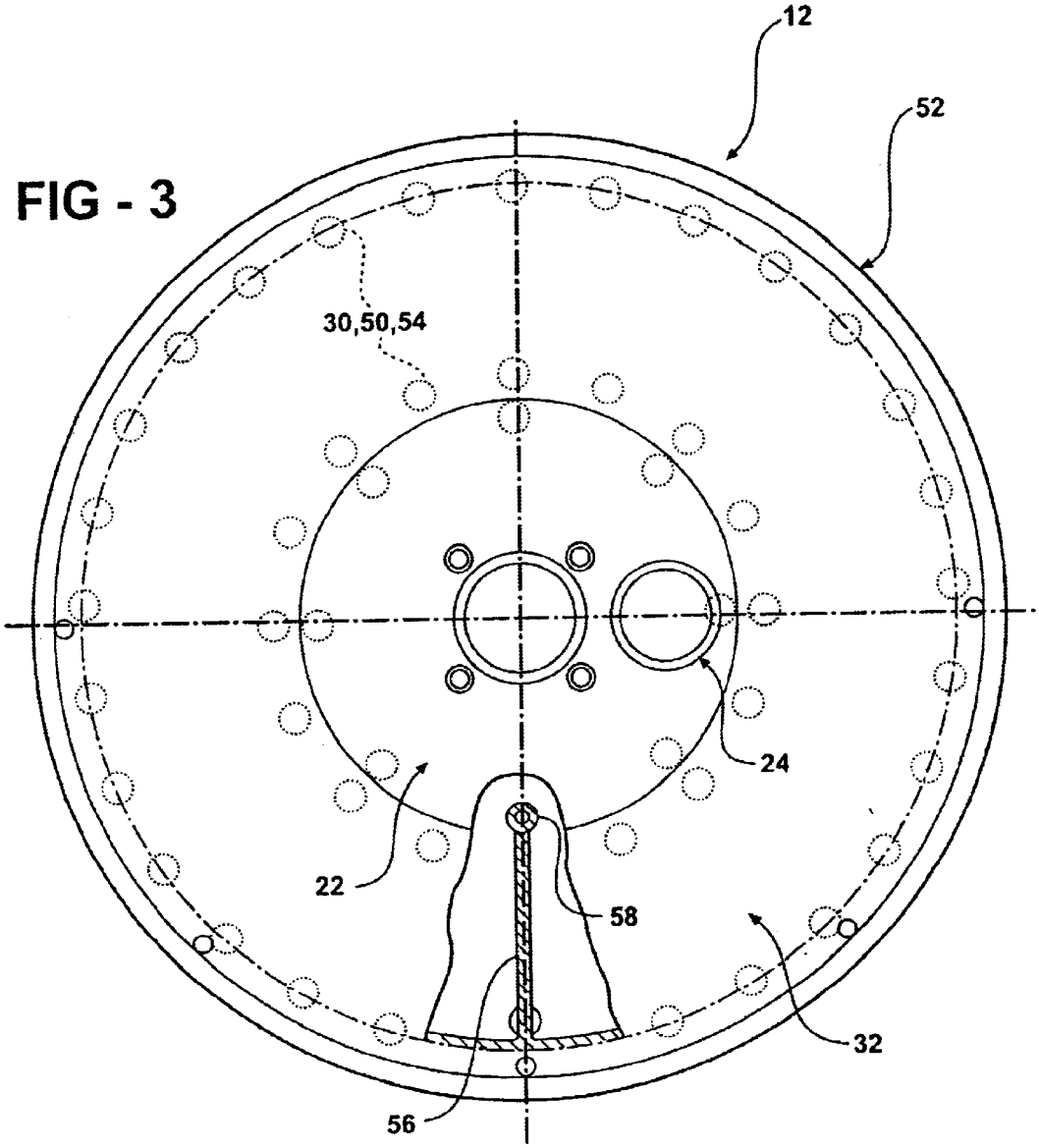
FIG. 3 is a schematic plan view, partially in section, illustrating a sanding pad assembly of the invention.
Figure 4:
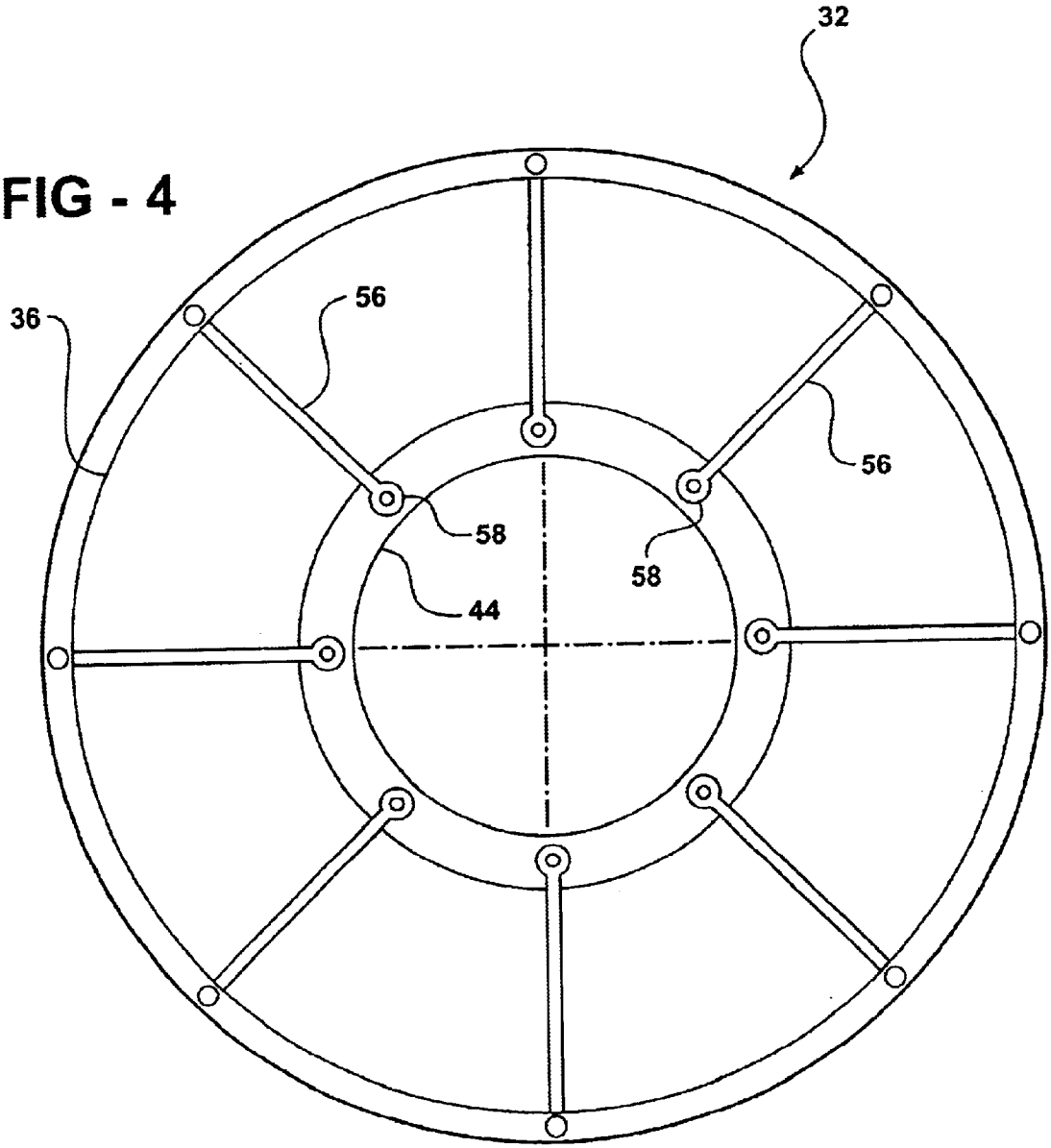
FIG. 4 is a sectional plan view of a suction ring of the invention illustrating a plurality of radially disposed ribs and like plurality of leg members forming a bridge-like structure.
Figure 5:
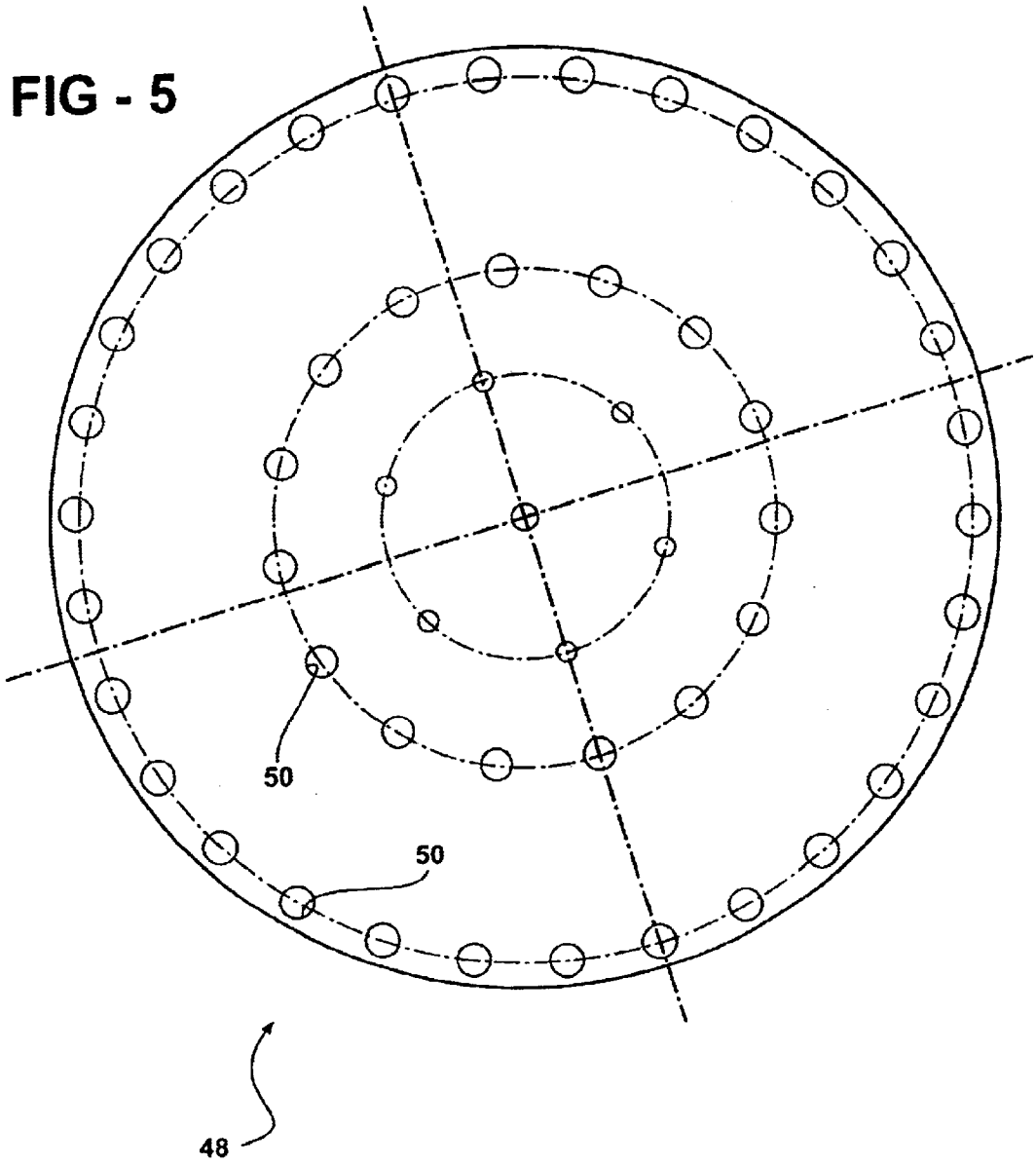
FIG. 5 is a plan view of a sanding pad illustrating the hole configuration therein and in the pad backing.

In one embodiment, best seen in FIGS. 3 and 4, the suction ring 32 includes a plurality of radially disposed ribs 56 that extend generally from circumferential side wall 36 to a like plurality of leg members 58 disposed about the opening 44 in the circular back wall 42 forming a bridge-like structure. In the illustrative embodiment, there are eight ribs 56 and eight leg members 58. The ribs 56 have a section that extends perpendicular to the pad backing 28 and with the suction ring 32 mounted together with the sanding pad assembly 26 to act as one, the assembly is greatly stiffened against possible deformation at high rotational speeds.

Preferably, the suction ring 32 is made of aluminum as is the pad backing 28. High impact plastic construction may be used, but is less durable in commercial applications.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A suction ring for an orbital sander including a motor having a rotatable shaft with a radially off-set portion, a suction housing mounted to the motor around the motor shaft and connectable with a vacuum source for supplying vacuum pressure around the shaft, and a sanding pad assembly having a plurality of apertures therethrough, said suction ring comprising:

an annular frame mountable on said rotatable shaft and adapted for rotation therewith, said annular frame having a circumferential side wall including first and second circumferential axially spaced edges and disposed between said suction housing and said sanding pad assembly;

one of said edges defining an opening and adapted to mount to the sanding pad assembly thereon, said edge being a lower edge of said side wall; and a circular back wall extending generally radially inward from the other of said circumferential edges and having an opening therein for communicating said vacuum pressure from said suction housing through said suction ring to said orbital sanding pad assembly;

said back wall being continuous with the other of said circumferential edges of said circumferential side wall;

whereby said sanding pad assembly is rotatably supported against flapping by said rotating suction ring and sanding waste can be communicated through said plurality of apertures of said sanding pad and through said suction ring to said suction housing.

2. The suction ring of claim 1 further comprising:

a plurality of radially disposed ribs extending generally from said circumferential side wall to a like plurality of leg members disposed about said opening in said circular back wall, stiffening said suction ring and sanding pad assembly.

3. The suction ring of claim 1 wherein said ring is made generally of aluminum material.

* * * * *